US006178682B1

(12) United States Patent
Zedrosser et al.

(10) Patent No.: US 6,178,682 B1
(45) Date of Patent: Jan. 30, 2001

(54) REPEATING RIFLE WITH SEMIRIGIDLY LOCKABLE BOLT ACTION AND STRIKING-PIN SAFETY

(75) Inventors: Ulrich Zedrosser, Steyr; Hubert Kefer, Bad Ischl, both of (AT)

(73) Assignee: Steyr-Daimler-Puch Aktiengesellschaft, Vienna (AT)

( * ) Notice: Under 35 U.S.C. 154(b), the term of this patent shall be extended for 0 days.

(21) Appl. No.: 09/194,900

(22) PCT Filed: Jun. 6, 1997

(86) PCT No.: PCT/AT97/00117

§ 371 Date: Dec. 4, 1998

§ 102(e) Date: Dec. 4, 1998

(87) PCT Pub. No.: WO97/47941

PCT Pub. Date: Dec. 18, 1997

(30) Foreign Application Priority Data

Jun. 7, 1996 (AT) ..... 986/96

(51) Int. Cl.[7] ..... F41A 3/26; F41A 17/42
(52) U.S. Cl. ..... 42/16; 42/69.02; 42/70.08
(58) Field of Search ..... 42/69.02, 16, 70.08

(56) References Cited

U.S. PATENT DOCUMENTS 2,649,800 * 8/1953 Peters ..... 42/16
3,416,253 * 12/1968 Larsson ..... 42/16
3,979,849 * 9/1976 Haskins ..... 42/16
3,996,684 * 12/1976 Bauman et al. ..... 42/16
4,152,855 * 5/1979 DuBiel et al. ..... 42/16
4,454,672 * 6/1984 Timari ..... 42/16
4,547,988 * 10/1985 Nilsson ..... 42/16
4,698,931 * 10/1987 Larsson ..... 42/16
4,719,714 * 1/1988 Palmisano ..... 42/16
5,259,137 * 11/1993 Blenk et al. ..... 42/16
5,718,073 * 2/1998 Sachse et al. ..... 42/16

FOREIGN PATENT DOCUMENTS 0096028 12/1987 (AT) .
3724936 * 6/1988 (DE) .
3718431 * 12/1988 (DE) .

* cited by examiner

*Primary Examiner*—Darren W. Ark
(74) *Attorney, Agent, or Firm*—Bachman & La Pointe, P.C.

(57) ABSTRACT

A repeating rifle having a bolt action comprises a breech housing (1), a breech body (3) which can be moved and can be rotated in this breech housing (1) and has a movable plug (4) and a firing pin (6) which is loaded by a firing pin spring (7) and has a cocking piece (8), in which case the breech body (3) has in its interior a cocking guide which interacts with the cocking piece (8). In order to achieve maximum safety and maximum operating convenience with as little physical complexity as possible, a cocking cam bush (33) is guided such that it can be moved in the longitudinal direction in the breech body (3) as the cocking guide, on which cocking cam bush the firing pin spring (7) is supported, and the plug (4) has a guide sleeve (36) which interacts with the cocking cam bush (33).

4 Claims, 3 Drawing Sheets

REPEATING RIFLE WITH SEMIRIGIDLY LOCKABLE BOLT ACTION AND STRIKING-PIN SAFETY

BACKGROUND OF THE INVENTION

The invention relates to a repeating rifle having a bolt action, comprising a breech housing, a breech body which can be moved and can be rotated in this breech housing and has a movable plug and a firing pin which is loaded by a firing pin spring and has a cocking piece, in which case the breech body has in its interior a cocking guide which interacts with the cocking piece.

AT PS 759051/393 discloses, for example, such a repeating rifle in which the cocking guide is incorporated in the bolt, at the bottom. Although the bolt handle is connected by the force of the firing pin spring to the breech body without any play, no measures are taken, however, to fix it in any position. The plug, which is connected to the breech body, is designed as a bolt safety device there, and can be rotated with respect to the breech body only for this purpose. It is equipped with a trigger vane which points to the rear, for which reason it is also referred to as a vane safety device.

Despite the direct bolt safety device, this design cannot satisfy the requirements now placed on safety and operating convenience. The safety device is bulky, cumbersome and difficult to move, and, in particular, interferes with the fitting of a telescopic sight. In order to remove the breech body, the trigger must be moved forward or, alternatively, the breech body can be fitted and removed even with a weapon which has not been made safe, but both of these are dangerous. The bolt handle cannot be fixed in any position and thus also represents a safety risk since it can inadvertently be entirely or partially unlocked, for example by being placed down on a rucksack.

An externally located, separate retaining spring was admittedly used for fixing the breech body as early as 1903 in the Mannlicher-Schonauer hunting rifle. However, such a retaining spring which acts all the time is stressed even when the breech is not cocked and thus unnecessarily increases the cocking resistance on opening, which detracts from the operating convenience.

The object of the invention is thus to provide a repeating rifle of the type described above wherein maximum safety and maximum operating convenience are achieved with the minimum possible structural complexity.

SUMMARY OF THE INVENTION

The foregoing object is achieved according to the invention wherein a cocking cam bush is guided such that it can be moved in the longitudinal direction in the breech body as the cocking guide, on which cocking cam bush the firing pin spring is supported, and in that the plug has a guide sleeve which interacts with the cocking cam bush.

The interaction of the cocking bush, the firing pin spring and the guide sleeve, in which case the cocking bush is coupled in a rotationally fixed manner to the breech body which can rotate, and the guide sleeve is coupled in a rotationally fixed manner to the plug which cannot rotate, results in the bolt being fixed in various angular positions and a direct bolt safety device, without its own separate springs. In addition, the preconditions are created for a range of other operational simplifications and safety measures.

In accordance with a further feature of the invention, the cocking cam bush has a locking guide which interacts with a cam on the guide sleeve and is formed by a saddle having rising flanks adjacent thereto on both sides, in which case the cam rests in the saddle when the breech body is located in the firing position, and in which case, when the breech body rotates in either direction, the cam moves the cocking cam bush against the stress of the firing pin spring, by sliding on one rising flank, or the other.

Thanks to the locking guide, the additional bolt safety device can also be brought into effect by moving the breech body to a further angular position by movement of the bolt handle, in which case the cam is pressed against one flank of the locking guide. In this further angular position, the bolt handle is resting entirely against the weapon. The saddle in the locking guide, which is loaded by the firing pin spring, holds the breech body in the firing position in a particularly simple manner. If the breech body is rotated counterclockwise for unlocking, the cam presses against the other rising flank of the locking guide. This displaces the cocking cam bush against the force of the firing pin spring. At the same time, the cocking cam bush interacts, however, via its cocking guide with the cocking piece, as a result of which an ergonomic force profile during unlocking and cocking is achieved, even with a cocking guide form that is simple to manufacture.

In an advantageous embodiment, the cocking piece has a release plunger which points downward, and the breech body has a recess at its rear edge, in which case this recess comes to rest in front of the release plunger only when the breech body is in the firing position. The rotation between the breech body and the plug with the guide sleeve is thus additionally used for the direct bolt safety device, for which purpose only the recess need be incorporated.

There are other options for locking the breech body in the position with the bolt safety device. One particularly simple option is to arrange a latching tab in the circumferential direction on the breech body and to mount a longitudinally located slide rod, which is operated by a safety catch, on the breech housing such that it can move, in which case the latching tab is held by the slide rod when the breech body is in the transportation safety position and the safety catch is inserted. In consequence, the breech body jumps to the firing position when the safety catch is released, and the bolt safety device is removed.

In a preferred embodiment, the cocking guide and the locking guide are combined on one radius on the cocking cam bush. The cocking cam bush thus becomes a component which is particularly easy to manufacture, as well as occupying little physical space.

A further simplification and advantageous force relationships are achieved in that the combined cocking guide and locking guide extends over an angle of 180° and is present twice on the cocking cam bush, in which case the guide sleeve has two cams spaced apart by 180°, and the cocking piece has teeth which are each located between two cams In consequence, the requirement for physical space is also kept very low, and the machining process is simple.

BRIEF DESCRIPTION OF THE DRAWINGS

The invention will be described and explained in the following text with reference to figures, in which.

DETAILED DESCRIPTION

Figure 1:
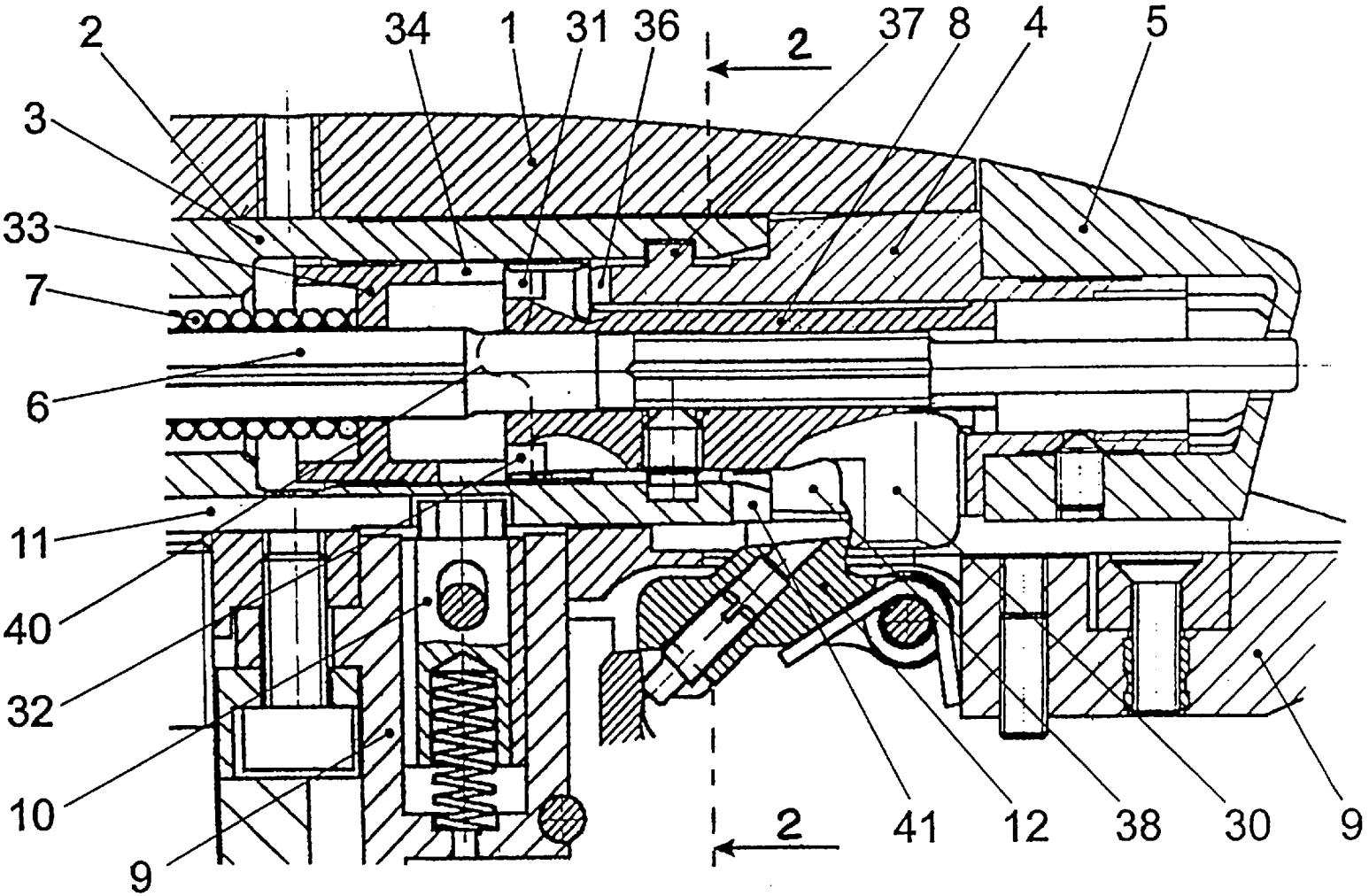
FIG. 1 shows a partial vertical longitudinal section through a repeating rifle according to the invention.

In FIG. 1, the breech housing is denoted by 1. In its interior, this has a cylindrical guide surface 2 in which a cylindrical breech body 3 is guided such that it can be moved longitudinally and can rotate. A plug 4 is arranged behind it and can be moved with the breech body 3 in the longitudinal direction, but cannot be rotated with the latter. An end cap 5 is also fitted to the plug 4. A firing pin 6 is guided in the interior of the breech body 3 such that it can be moved longitudinally, and a firing pin spring 7 acts on it in the firing direction, with a cocking piece 8 being attached to its rear part. A trigger housing 9 is screwed to the underneath of the breech housing 1. Only part of this can be seen and its contents are not illustrated, in the same way as a safety catch which is likewise present and is located in the trigger housing—for example in the rear part. A breech holder 10 is guided in the trigger housing 9 such that it can be moved vertically, and is spring-loaded in the upward direction. This breech holder 10 engages in a guide groove 11 in the breech body 3. This guide groove 11 first of all runs in the circumferential direction and then forward in the axial direction over the majority of the length of the breech body 3. There, it forms a stop which prevents the breech body 3 from being pulled out completely when the breech holder 10 is in the position shown. Finally, 12 also denotes a catch which is mounted in the trigger housing 9, holds the cocking piece 8 against the force of the firing pin spring 7 in the firing position, and is released to fire a shot.

For this purpose, the cocking piece 8 has a release plunger 30 underneath at its rear end. Two cocking teeth which are offset through 180° are provided at the front end of the cocking piece, an upper tooth 31 and a lower tooth 32. When the firing spring 7 is being cocked, these teeth interact with a cocking guide 34, which is formed on a cocking cam bush 33. This cocking cam bush 33 can be moved longitudinally, but is guided in a rotationally fixed manner in the interior of the breech body 3, with the firing pin spring 7 being used as an opposing bearing. At its front end, the plug 4 forms a guide sleeve 36 which can be rotated with respect to the breech body 3, and thus with respect to the cocking cam bush 33. However, it is connected via segments 37 in the axial direction, which are guided in an inner circumferential groove in the breech body 3. The figure does not show interruptions in the groove, which allow disassembling in a specific angular position. A longitudinal slot 38 is provided on the underneath of the plug 4, through which slot the release plunger 30 projects. The firing pin 6 is connected in a rotationally fixed manner through this slot 38 to the plug 4. At its front end, the guide sleeve 36 has cams 40 (shown by dashed lines) which are offset through 180°, against which the firing pin spring 7 presses the cocking guide 34. The interaction of the cocking cam bush 33, cocking piece 8 and guide sleeve 36 will be returned to later. A recess 41 is provided on the rear edge of the breech body 3 and, in the firing position when the safety catch has been released, allows the release plunger 30 to move forward. In all the other safety states, the recess 41 is rotated with respect to the release plunger 30—the firing pin cannot be actuated. This results in a safety device which acts directly on the firing pin, a so-called bolt safety device.

Figure 2:
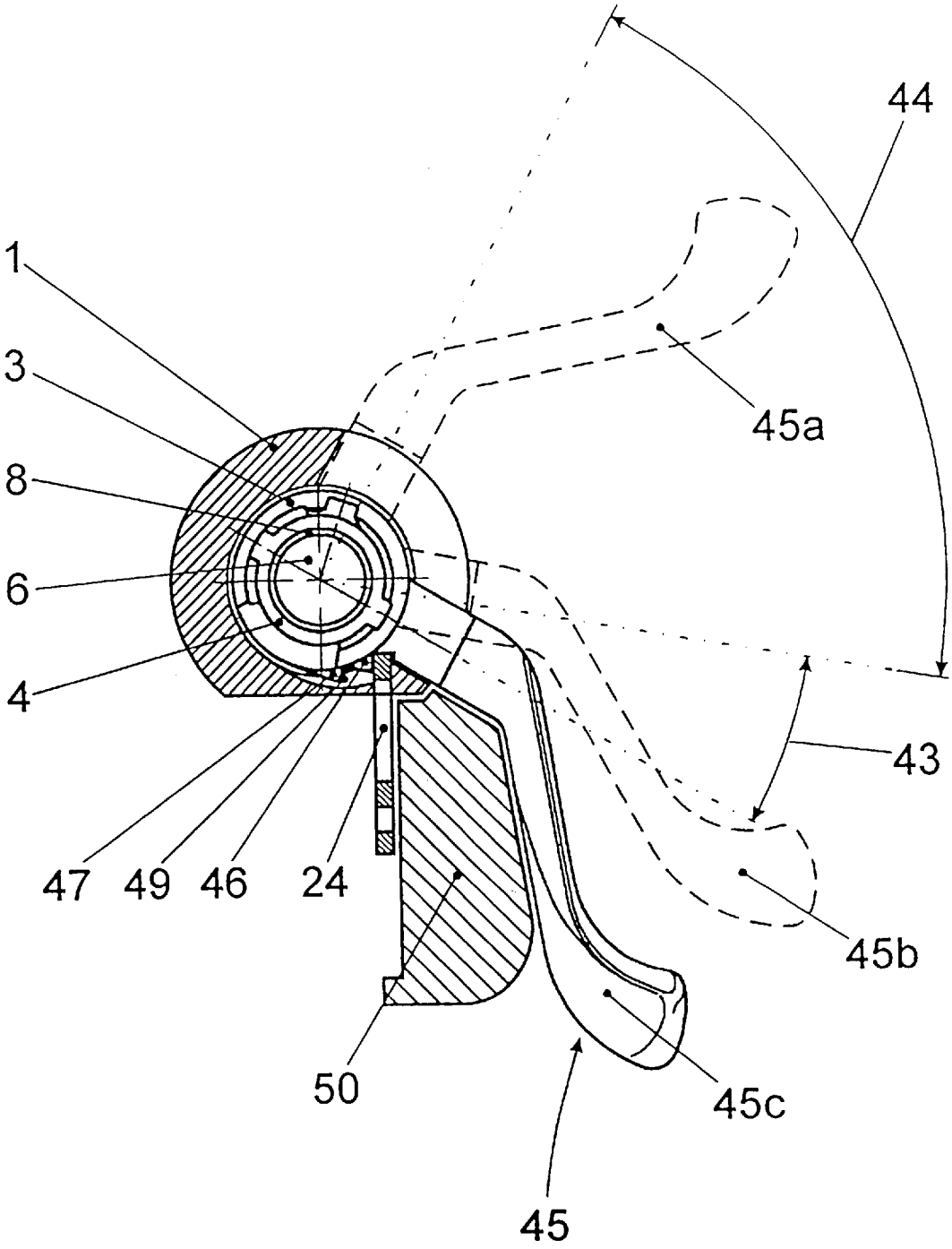
FIG. 2 shows the section along II—II in FIG. 1, reduced.

The cross section in FIG. 2 shows a bolt handle 45 which is integrally or permanently connected to the breech body 3, illustrated in three different positions. In the position 45*a*, the breech body 3 is unlocked and can be moved in the longitudinal direction; rotating it onward through a specific angle 44 in the clockwise direction, which angle corresponds to the construction of the interlock (which is not illustrated) of the breech body, a position 45*b* is reached, which is the firing position; rotating it onward through a relatively small angle 43, a safe-for-transportation position is reached, in which the bolt handle rests very closely against the stock, which is indicated by 50.

The plug 4 and the breech body 3 are also located in this position 45*c*. A first latching tab 46 running in the circumferential direction and a second latching tab 47 can be seen on this breech body 3, successively in the clockwise direction. The latter latching tab is considerably broader in the longitudinal direction than the first latching tab 46. Only part of a slide rod 24 is shown, the rest being guided on the trigger housing 9, on which the safety catch is also located. In the position shown, the first latching tab 46 is pressed by the force of the firing pin spring—as is still to be explained—against the slide rod 24. The breech body 3 is thus held firmly in the safe-for-transportation position. Moving the slide rod 24 by means of the safety catch, which is not illustrated, releases the first latching tab 46, and the breech body 3 jumps to the firing position, corresponding to the bolt handle position 45*b*. In this position, the second latching tab 47 rests against the slide rod 24. A turned-out region 49, which is wedge-shaped in the circumferential direction, is provided to create space for the two latching tabs 46, 47 in the breech housing 1.

Figure 3:
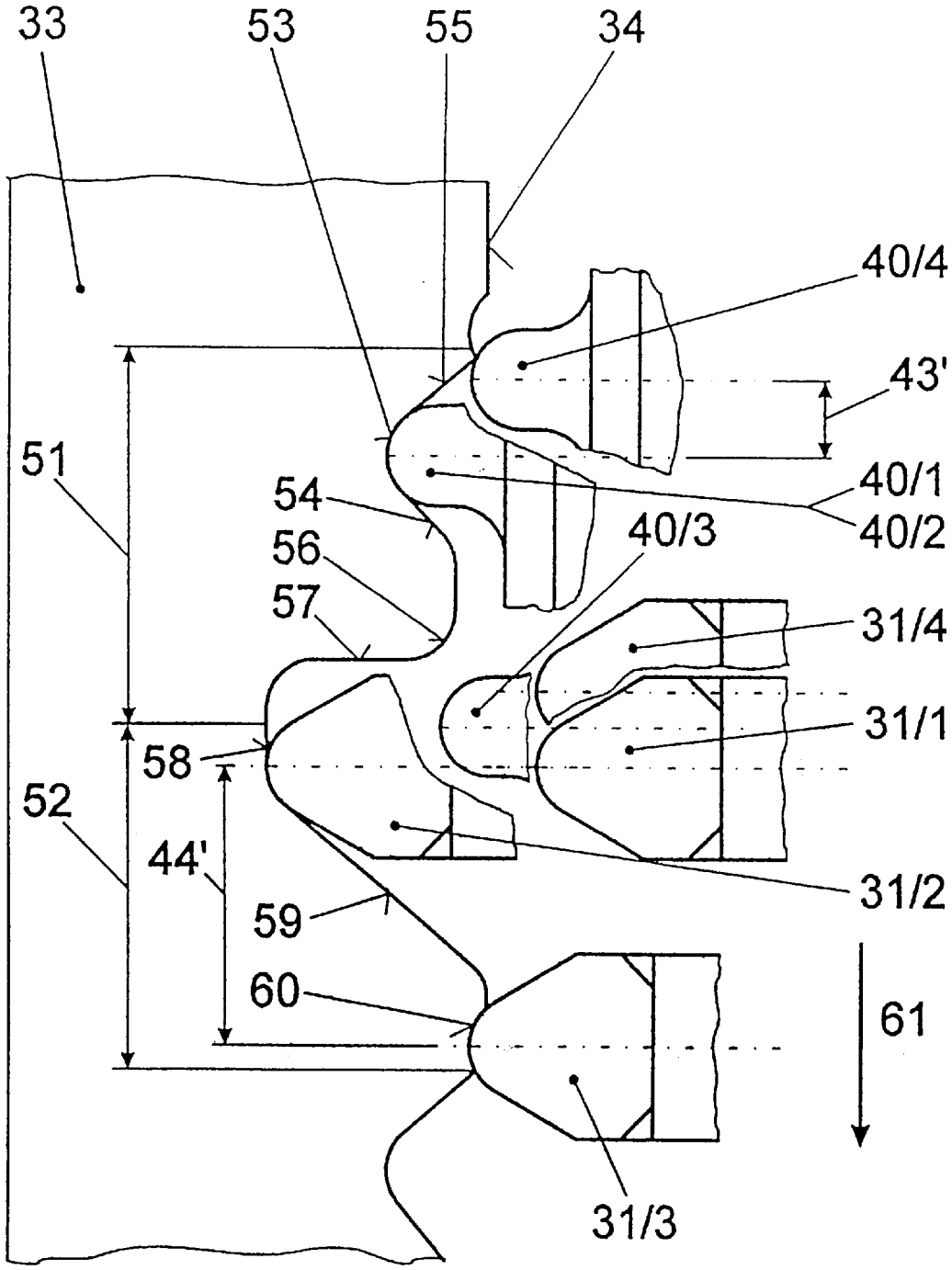
FIG. 3 shows a schematic illustration of various positions.

FIG. 3 shows the cocking guide 34, which is spread out in the plane, of the cocking cam bush 33. In the chosen representation of the various positions, it is fixed, the illustration showing a cam 40 on the guide sleeve 36 as well as the upper cocking tooth 31 of the cocking piece 8 in the various positions. In this case, the directional arrow 61 corresponds to a movement of the bolt handle 45 counterclockwise. In the preferred embodiment shown, the locking guide 51 and the cocking guide 52 are arranged in a row and there are two of them on the entire circumference since, in fact, there are also two cams 40 and cocking teeth 31, 32, offset through 180° with respect to one another.

The locking guide 51 consists of a saddle 53 with, adjacent to it on both sides, a first flank 54 and a second flank 55, and, finally, a rounded region 56 which is followed by a steep grade 57 to the base 58 of the cocking guide 52.

The cocking guide 52 then has a cocking ramp 59, whose highest point follows a latch 60. The various positions are denoted by numbers from 1 to 4, and the reference symbols of the cocking tooth 31 and cam 40 are followed by an oblique line.

In the position 1, the rifle is ready to fire. The bolt handle 45 is in the position b in FIG. 2; the cocking tooth 31/1 is held by the catch 12 (FIG. 1); the cam 40/41 is located in the saddle 53. The cocking tooth 31/1 is located above the base 58 of the cocking cam.

If a shot is fired, the cocking piece 8 jumps forward, and the cocking tooth moves to the second position 31/2.

In order to cock the firing pin spring and at the same time to unlock the breech body 3, the bolt handle is rotated counterclockwise (arrow 61), during which two things happen: the cocking tooth 31 is pushed back along the cocking ramp 59, the firing pin spring 7 being cocked, beyond the highest point into the position 31/3, in which there may be, but need not be, a catch 60. At the start of this rotational movement, the cam 40 must also move out of the saddle 53 along the first flank 54 and then continue without any longitudinal movement, until it comes to rest behind the rounded region 56 in the position 40/3. During the first phase of this movement, the cocking cam bush 33 is, however, in fact forced to the left, as a result of which the cocking ramp 59 also moves somewhat backward. In consequence, the ergonomically favorable action of a sinusoidal shape is achieved, despite the straight cocking ramp 59. By suitable selection of the rounded region 56 and/or of the catch 60, the relevant parts are held in the indicated position even during the displacement movement which now follows, for loading.

If the bolt handle is now rotated to the firing position again, then the cam 40 once again moves out of the position 40/3 back to the position 40/1, the saddle 53 once again marking the firing position. At the same time, the cocking tooth 31 once again moves back from the position 31/3 to the position 31/1. In the process, it not only moves through the distance 44' which corresponds to the angle 44 in FIG. 2, but is also moved backward somewhat. The reason for this is the locking movement of the breech, during which the firing pin spring 7 is tensioned further after striking against the catch 12 (FIG. 1).

If the safe-for-transportation position is now intended to be assumed, then the bolt handle 45 is rotated in the clockwise direction again through 43', corresponding to the angle 43 in FIG. 2. In the process, the cam 40 moves from the position 40/1 to the position 40/4, having to climb up the second flank 55 against the force of the firing pin spring 7. This position is then held owing to the fact that the first tab 46 shown in FIG. 2 is held by the slide rod 24 when the latter is in the safe-for-transportation position. If it is moved from this position, then the cam 40 snaps back into the saddle 53 once again, owing to the force of the firing pin spring 7.

What is claimed is:

1. A repeating rifle having a bolt action, comprising a breech housing (1), a breech body (3) which can be moved and can be rotated in this breech housing (1) and has a movable plug (4) and a firing pin (6) which is loaded by a firing pin spring (7) and has a cocking piece (8) provided with teeth (31,32), wherein the breech body (3) has on an interior surface a cocking guide (52) which interacts with the teeth (31,32) of cocking piece (8), wherein a cocking cam bush (33) is guided and moved in the longitudinal direction in the breech body (3) as the cocking guide, on which said cocking cam bush the firing pin spring (7) is supported, is engaged by teeth (31,32) and wherein the plug (4) has a guide sleeve (36) which interacts with the cocking cam bush (33) wherein the cocking cam bush (33) has a locking guide (51) which interacts with a cam (40) on the guide sleeve (36) and is formed by a saddle (53) having rising flanks (54,55) adjacent thereto on both sides, wherein the cam (40) rests in the saddle (53) when the breech body (3) is located in the firing position, and wherein the breech body rotates in either direction, the cam (40) moves the cocking cam bush (33) against the stress of the firing pin spring (7), by sliding on one of the rising flanks (54,55).

2. The repeating rifle having a bolt action as claimed in claim 1, wherein the cocking piece (8) has a release plunger (30) and the breech body (3) has a recess (41) at a rear edge, wherein the recess comes to rest in front of the release plunger (30) only when the breech body (3) is in the firing position.

3. The repeating rifle having a bolt action as claimed in claim 1, wherein a latching tab (46,47) is arranged on a circumferential surface of the breech body (3) and a slide rod (24), which is operated by a safety catch, is mounted on the breech housing (1) and is movable to engage the latching tab (46,47) and hold the slide rod.

4. The repeating rifle having a bolt action as claimed in claim 1, wherein the cocking guide (34) and the locking guide (34) are combined on one radius on the cocking cam bush (33).

* * * * *